US005597150A

United States Patent [19]

Stein et al.

[11] Patent Number: 5,597,150

[45] Date of Patent: Jan. 28, 1997

[54] PILFER-RESISTANT PEG HOOK ASSEMBLY

[75] Inventors: Arthur Stein, Whitestone, N.Y.; William C. Updegrave, Jackson, N.J.

[73] Assignee: Display Technologies, Inc., Whitestone, N.Y.

[21] Appl. No.: 408,726

[22] Filed: Mar. 22, 1995

[51] Int. Cl.[6] ..... F16M 13/00

[52] U.S. Cl. ..... 248/551; 248/303; 211/59.1; 211/57.1

[58] Field of Search ..... 248/551, 302, 248/303, 309.1; 211/59.1, 57.1, 106

[56] References Cited

U.S. PATENT DOCUMENTS

| | | | |
|---|---|---|---|
| 1,755,927 | 4/1930 | Levinsohn | 211/57 |
| 2,205,298 | 6/1940 | Lindner | 133/11 |
| 3,655,061 | 4/1972 | Peschcke-Koedt | 211/57 |
| 3,785,501 | 1/1974 | Canning | 211/57 |
| 4,013,252 | 3/1977 | Braverman | 248/220.4 |
| 4,104,817 | 8/1978 | Herzog | 40/19.5 |
| 4,394,909 | 7/1983 | Valiulis et al. | 211/59.1 |
| 4,474,300 | 10/1984 | Entis | 211/57.1 |
| 4,646,454 | 3/1987 | Fast | 40/124.1 |
| 4,850,557 | 7/1989 | Valiulis | 248/220.4 |
| 4,905,846 | 3/1990 | Calvert | 211/54.1 |
| 4,989,815 | 2/1991 | McAuley | 211/59.1 |
| 5,009,334 | 4/1991 | Bodkins | 211/57.1 |
| 5,014,949 | 5/1991 | Niven | 248/220.4 |
| 5,048,785 | 9/1991 | Shaw et al. | 248/306 |
| 5,082,215 | 1/1992 | Hutchison | 248/220.4 |
| 5,088,606 | 2/1992 | Boas | 248/220.3 |
| 5,375,725 | 12/1994 | Rosenthal | 211/59.1 |

*Primary Examiner*—Leslie A. Braun
*Assistant Examiner*—Willie Berry, Jr.
*Attorney, Agent, or Firm*—Amster, Rothstein & Ebenstein

[57] ABSTRACT

A pilfer-resistant peg hook assembly for supporting a plurality of articles incorporating defined slots and enabling only one article at a time to be removed therefrom is formed of a peg hook and a flipper. The peg hook has a pair of opposed ends and a body connecting the same. One of the hook ends is configured and dimensioned to maintain the hook body substantially horizontal when mounted on an appropriate surface, and the other of the hook ends is a free end. The hook body is configured and dimensioned to be received in the slots of the articles and defines a vertically extending bump adjacent to but spaced from the free end. The flipper is pivotably secured adjacent the free end and is movable between an enabling orientation enabling at least partial passage of an article along the book body and onto the flipper as the article moves towards the free end, and a blocking orientation precluding passage of an article onto the flipper as the article moves towards the free end. The flipper is cammed into the blocking orientation by an article passing over the bump.

11 Claims, 4 Drawing Sheets

PILFER-RESISTANT PEG HOOK ASSEMBLY

BACKGROUND OF THE INVENTION

The present invention relates to a peg hook for supporting a plurality of articles incorporating defined slots, and more particularly to a pilfer-resistant peg hook assembly enabling only one article at a time to be removed therefrom.

Blister packages and other carded articles offered for sale typically incorporate a defined slot which enables the articles to be mounted on a peg hook. The slots may be circular or elongate in the horizontal or vertical directions. The peg hooks serve the function of compactly storing the articles for sale and at the same time providing the prospective purchaser with a clear view of the front thereof. The peg hooks may be mounted at one end to an appropriate peg board, wall or stand (whether rotatable or stationary).

Unfortunately, the conventional peg hook permits the easy removal of not just the forward or leading article, but a plurality or series of the following articles as well. Thus, hit-and-run thieves frequently enter a retail establishment, grab with two hands a whole series of the articles on a peg hook, and, with a single movement, remove the entire series of articles from the peg hook in a fairly rapid operation. The thief may then either simply run away with the loot or rapidly conceal the articles and slowly withdraw from the retail establishment.

Clearly this type of hit-and-run operation can be prevented if the peg hook enables only the forward or leading article of the series to be removed from the peg hook one at a time. Thus, the thief must stand in front of the peg hook, making repeated hand motions in order to obtain a sufficient number of articles to justify the risks involved in the theft. The longer he must stand there removing the articles one-by-one from the peg hook, the greater the likelihood of his being noticed and apprehended.

The problem of pilfering from peg hood mounted displays is well recognized in the prior art as exemplified by U.S. Pat. No. 3,785,501 (a coin-operated system), U.S. Pat. No. 4,474,300 (a key-operated system), U.S. Pat. No. 5,009,334 (using a close-fitting cage about the front of the peg hook) and U.S. Pat. No. 5,014,949 (using an undulating peg hook). Unfortunately, each of these approaches to solving the problem of pilferage has in one way or another defeated the very purposes for which the peg hook display is intended. Thus, the simple, generally horizontal movement of even the forward or leading article is no longer sufficient, and, in the worst cases, extraneous elements such as coins or keys are necessary to enable removal of article from the peg hook. For example, for undulations of the peg hook to be sufficient to impede pilferage the undulations must be so exaggerated that the removal of even the forward or leading article becomes more of an up-and-down motion then a generally horizontal motion on the part of the potential customer. Furthermore, if a series of the articles are loosely held by the thief, several articles can be forced past the undulations (with the several articles moving up and down as necessary to accommodate the undulations), although the number of articles which can thus be removed by a thief in a single swipe is minimized.

Accordingly, it is an object of the present invention to provide a pilfer-resistant peg hook assembly which enables the removal of only one article at a time therefrom.

Another object is to provide such a peg hook assembly which enables a rapid and easy removal of the forward or leading article by a simple, substantially horizontal motion.

A further object is to provide such a peg hook assembly which is easy and convenient for the prospective purchaser to use and does not require the use of extraneous articles such as coins or keys.

It is also an object of the present invention to provide such a peg hook assembly which is simple and economical to manufacture, maintain and use.

SUMMARY OF THE INVENTION

It has now been found that the above and related objects of the present invention are obtained in a pilfer-resistant peg hook assembly for supporting a plurality of articles incorporating defined slots and enabling only one article at a time to be removed. The assembly comprises a peg hook and a flipper. The peg hook has a pair of opposed ends and a body connecting the same. One of the hook ends is configured and dimensioned to maintain the hook body in a first plane when mounted on an appropriate surface and the other of the hook ends is a free end. The hook body is configured and dimensioned to be received in the slots of the articles and defines a transversely extending bump adjacent to but spaced from the free end. The flipper is pivotably secured to the hook adjacent the free end and is movable between an enabling orientation enabling at least partial passage of an article along the hook body and onto the flipper as the article moves towards the free end, and a blocking orientation precluding passage of an article onto the flipper as the article moves towards the free end. The flipper is cammed into the blocking orientation by an article passing over the bump.

In a preferred embodiment, the flipper defines a generally planar front end and a generally planar rear end, the front and rear ends being disposed at an obtuse angle, preferably an obtuse angle of 140°–160°. The free end of the hook and the front end of the flipper are in the same plane when the flipper is in the enabling orientation and in intersecting planes when the flipper is in the blocking orientation. The rear end of the flipper and the body of the hook between the one end and the bump are in the same plane when the flipper is in the enabling orientation and in intersecting planes when the flipper is in the blocking orientation. The flipper front end is pivotally secured to the free end, and the flipper rear end extends generally towards the one end. The first plane is substantially horizontal, and the bump extends vertically, preferably upwardly.

Preferably the flipper is cammed into the enabling orientation by an article passing over the free end.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
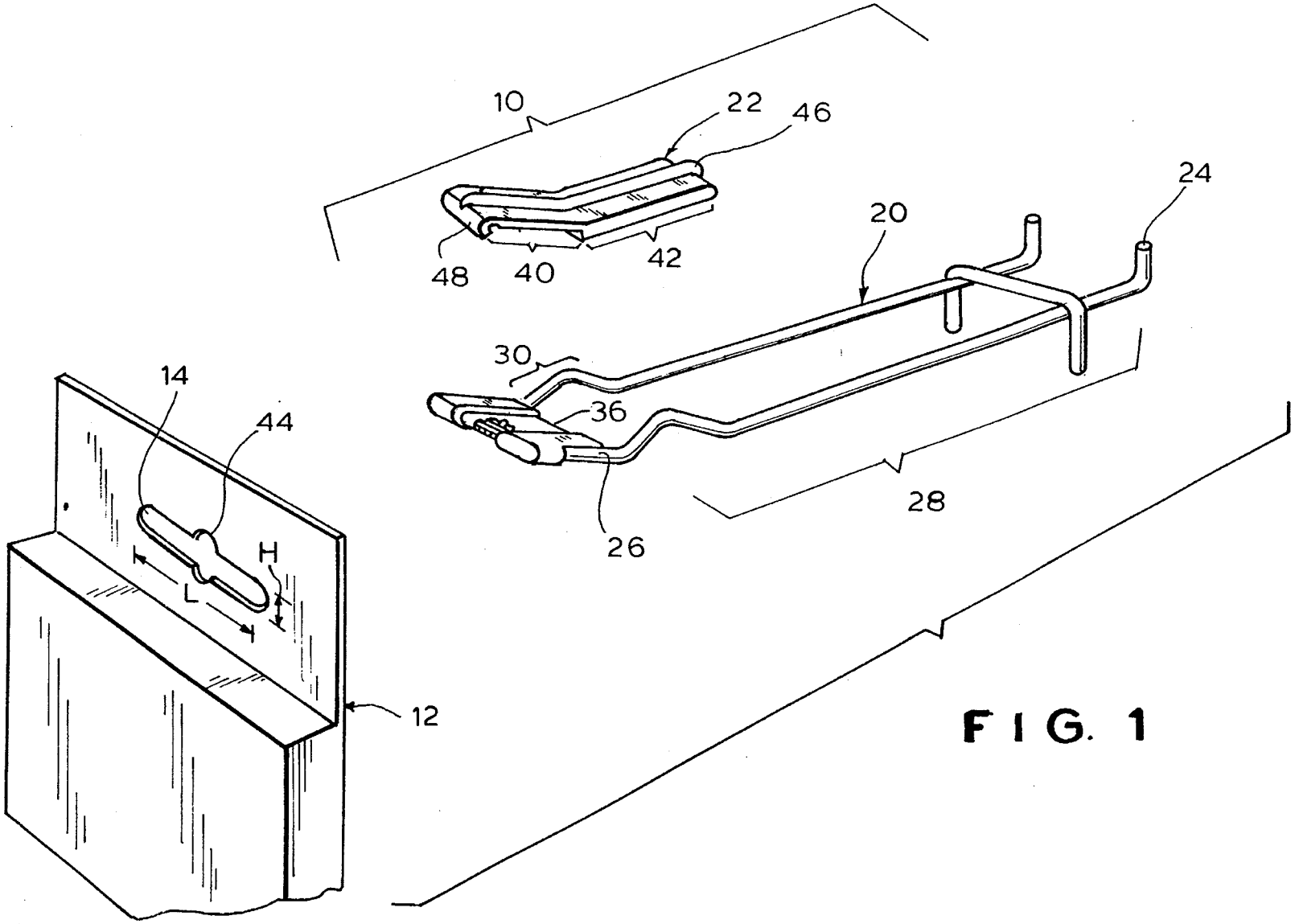
FIG. 1 is an exploded isometric view of the pilfer-resistant peg hook assembly of the present invention and a carded article for use therewith.

Referring now to the drawing, and in particular to FIG. 1 thereof, there illustrated is a pilfer-resistant peg hook assembly according to the present invention, generally designated by the reference numeral 10. The assembly 10 is designed for supporting a plurality of conventional articles, generally designated 12, such as blister packs and other carded articles. A wide variety of small products are frequently sold in such packages, including batteries, eyeglasses, toiletries, etc. The card portion of the article incorporates a well defined slot 14 formed therethrough, for example, by a die cut. The slot 14 has a length L and a height H, the length L being greater than the height H.

The assembly 10 comprises essentially a peg hook, generally designated 20, and a flipper, generally designated 22. The peg hook 20 has a pair of opposed longitudinal ends 24, 26 and a body 28 connecting the same. The hook end 24 is configured and dimensioned to maintain the hook body 28 projecting forwardly in a substantially horizontal plane when the hook end 24 is mounted on an appropriate surface such as a peg board (not shown). A wide variety of such hook ends 24 are well known in the peg hook art, and, for the purposes of illustration only, a simple upwardly extending flange at the rear end of the body 28 is shown. The other hook end 26 is a free end which is typically slightly upwardly inclined relative to the body 28, although a variety of different free ends well known in the peg hook art may be employed instead.

The hook body 28 is configured and dimensioned to be received in the article slot 14. The hook body 28 is generally planar and flat, but defines a bump 30, adjacent to but spaced from the free bump 3 end 26, which extends transversely to the hook body 28. The bump 30 is illustrated as extending vertically upwardly, although in particular applications a downward extending bump may be preferred. The front and rear halves of the bump 30 preferably define an obtuse angle of about 80°–100°, and optimally 90°, although other angles may also be used. The apex of the angle and the free ends of the angle legs (which contact the hook free end 26 or the remainder of the hook body 28) are appropriately rounded and smoothed to facilitate passage of an article slot 14 therealong.

The peg hook 20 is illustrated as being a U-shaped configuration, with the base and two legs thereof fitting snugly within the configuration and dimensions of the article slot 14. This is a preferred design as it precludes rotation of the article 12 about the peg hook 20 and provides a convenient mechanism for securing the flipper 22 thereto. However it will be appreciated that for particular applications a looser fitting peg hook 20 or even a single leg peg hook may be employed.

To assist the peg hook 22 in maintaining a "U" configuration, a rear bracing number 34 is secured across the two legs adjacent hook end 24, and a forward bracing member 36 is secured across the two legs adjacent the hook end 26 and in the same plane. It will be appreciated that the forward bracing member 36 limits the downward rotation of flipper 22 under the influence of gravity, acting as a stop for the flipper front arm 40, and hence the entire flipper 22.

The flipper 22 has a generally planar front arm 40 and a generally planar rear arm 42. The front and rear arms 40, 42 are disposed at and define an upwardly opening obtuse angle, preferably an obtuse angle of 140°–160° and optimally 151°. The front and rear arms 40, 42 are preferably configured and dimensioned to be received within the article slot 14. Thus, where the article slot 14 includes a small central groove 44 of the top thereof, the flipper 22 will preferably also include a raised central rib 46 extending along the top surface thereof. The flipper rib 46 cooperates with the card slot groove 44 in centering the article 12 for movement along the flipper 22, especially if the sides of the peg hook body 28 are not in contact with the ends of the article slot 14.

Figure 2:
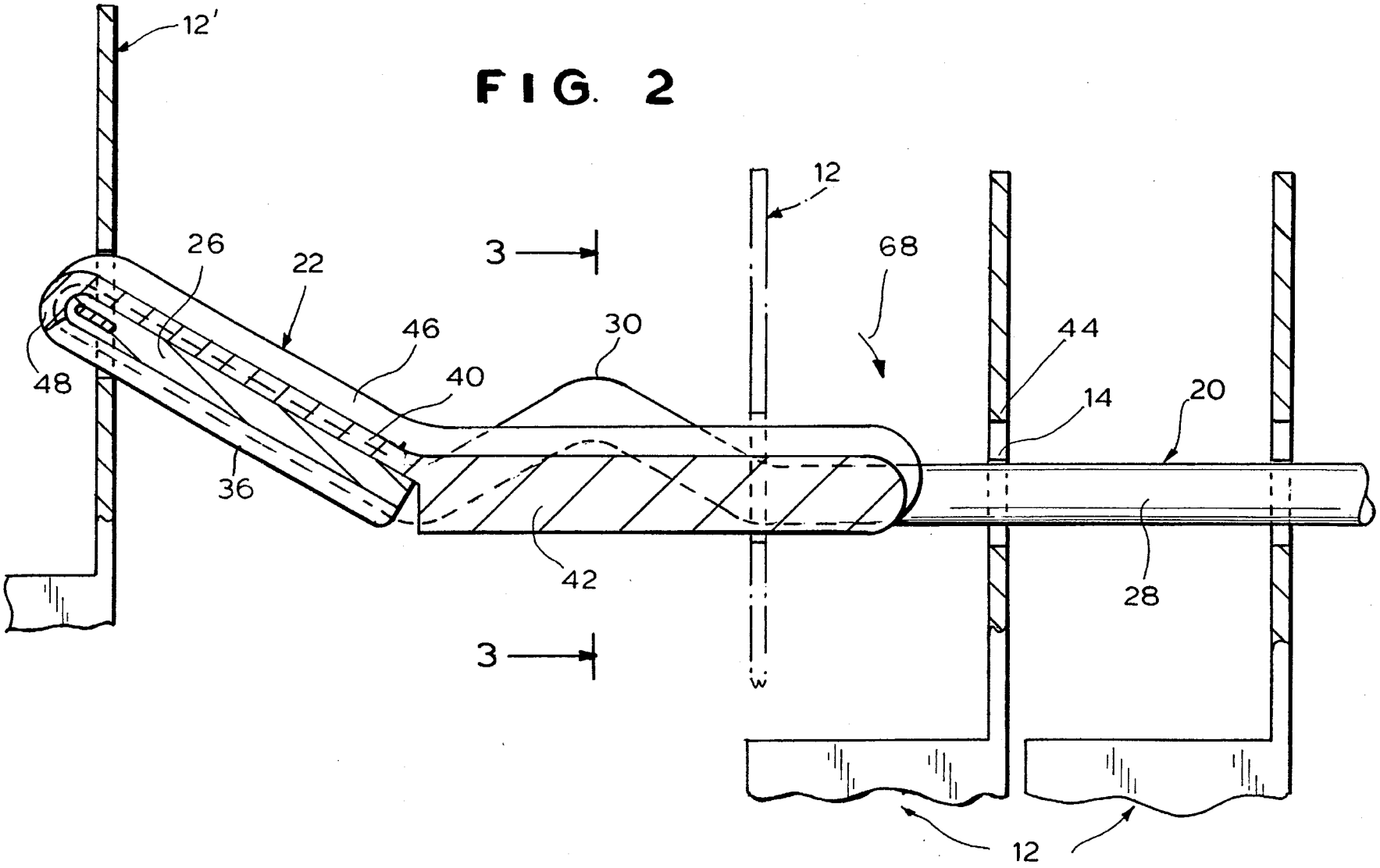
FIG. 2 is a side elevational view thereof with the flipper in the enabling orientation.
Figure 3:
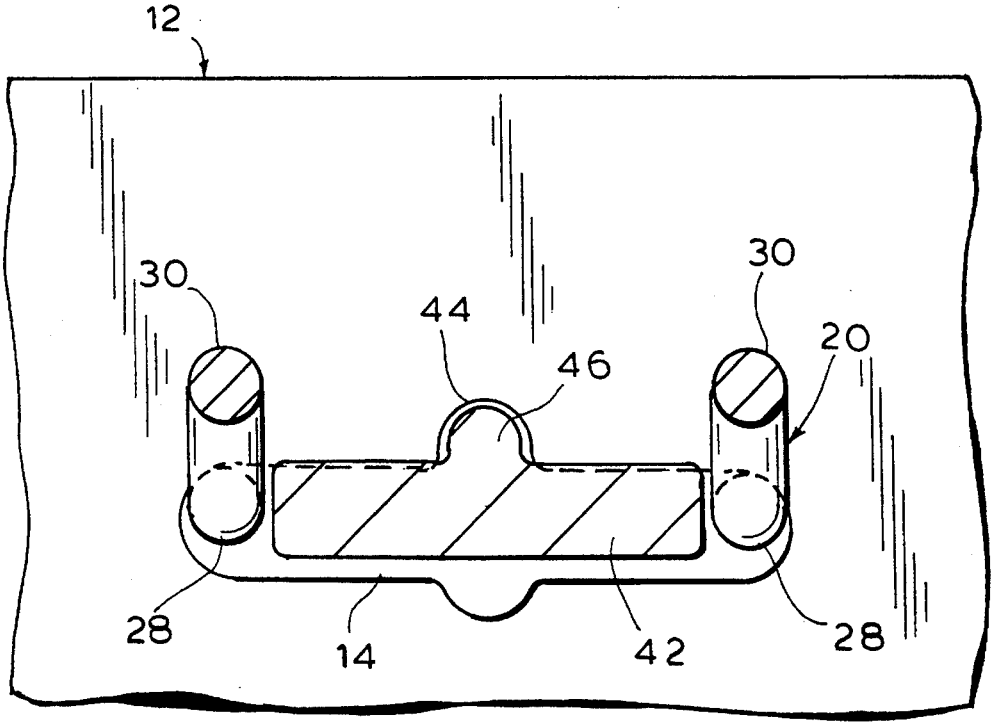
FIG. 3 is a sectional view taken along the line 3—3 of FIG. 2.
Figure 5:
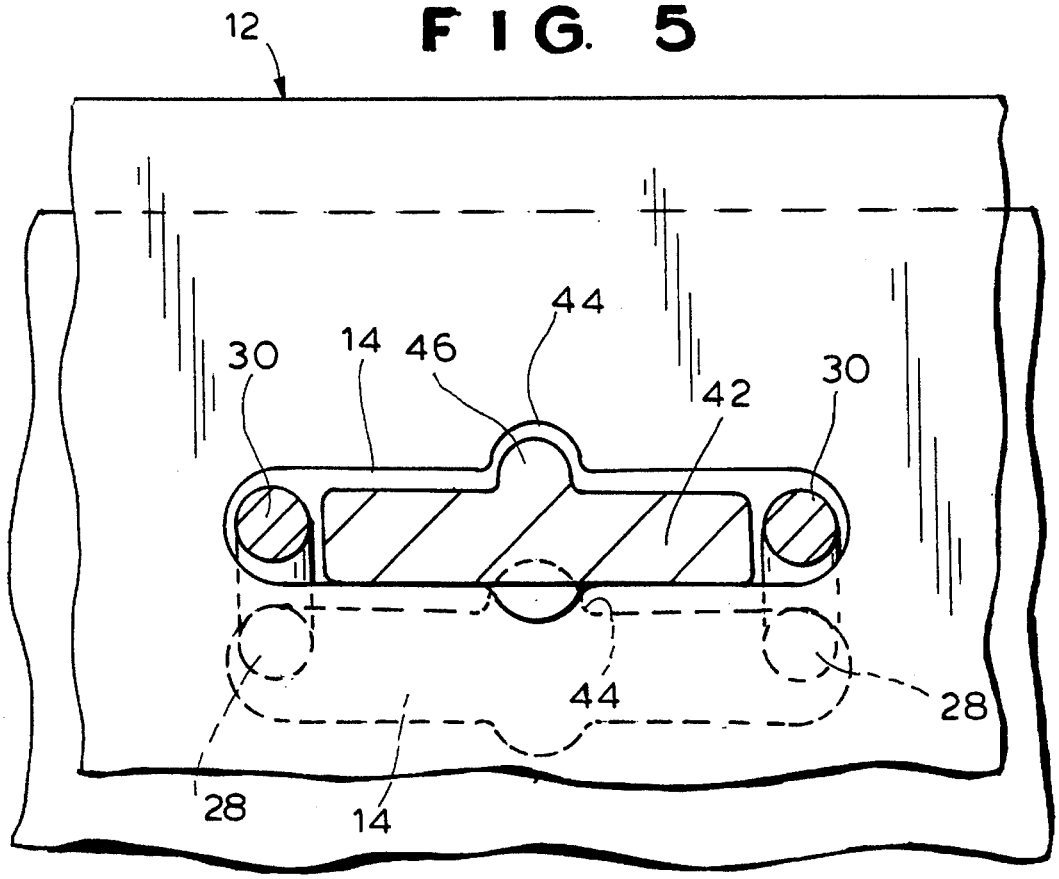
FIG. 5 is a sectional view taken along the line 5—5 of FIG. 4.
Figure 4:
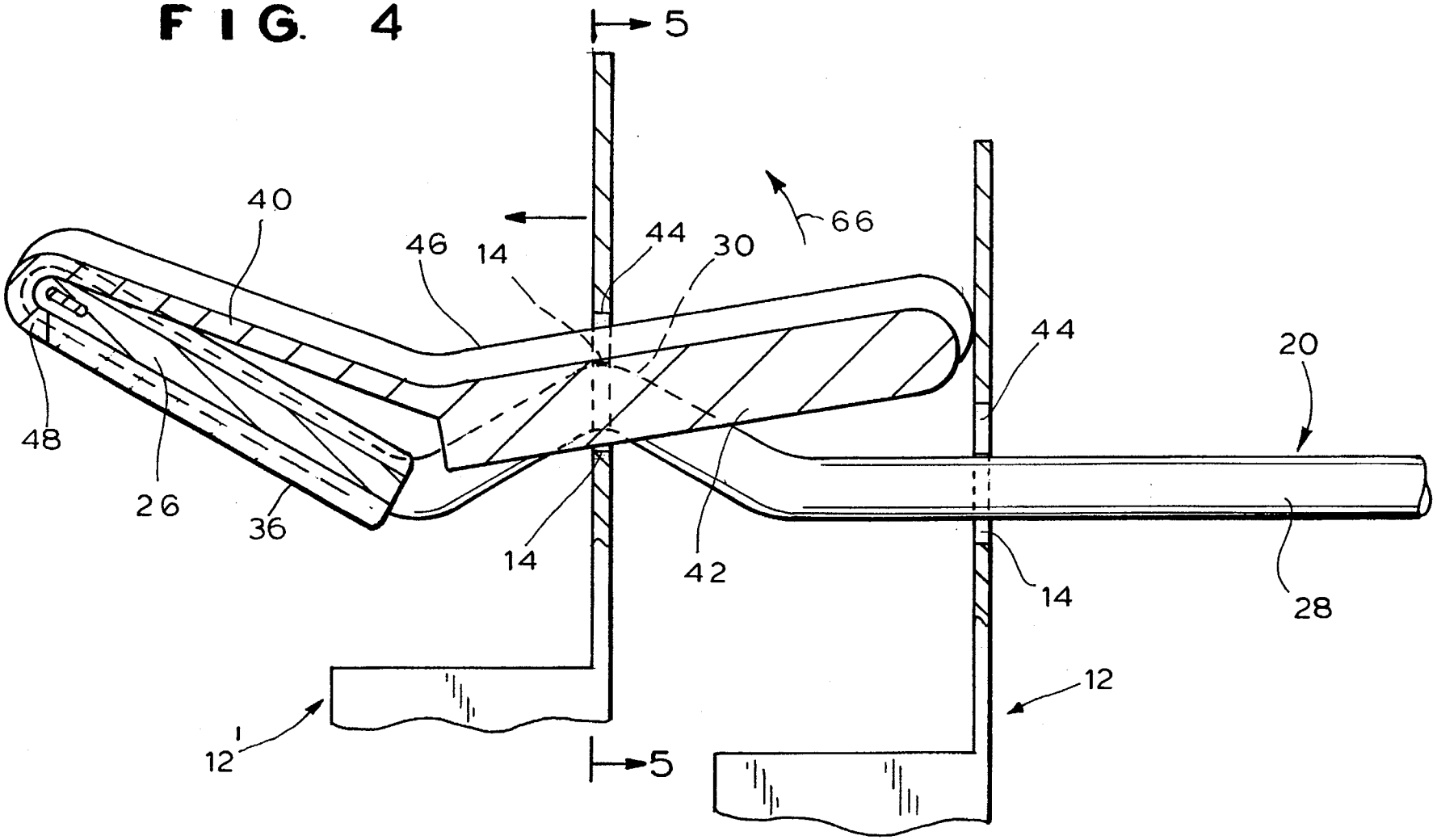
FIG. 4 is a side elevational view of the assembly with the flipper in the blocking orientation.

The front flipper arm 40 is of reduced width relative to the rear flipper arm 42. The front end of flipper 22 is configured and dimensioned to pivotably wrap around the base of the U-shaped peg hook 20—i.e., the front thereof. The ends of the base of the "U", which constitute the forward or leading end of the peg hook 20, permit the flipper 22 to be pivoted between an enabling orientation enabling at least partial passage of an article 12 along the hook body 28 and onto the flipper rear arm 42 as the article moves towards the body free arm 26 (as illustrated in FIG. 2), and a blocking orientation precluding passage of an article 12 onto the flipper rear arm 42 as the article 12 moves toward the hook free end 26 (as illustrated in FIG. 4). Thus the free end 26 of the hook 20 and the front arm 40 of the flipper 22 are in the same plane when the flipper 22 is in the enabling orientation illustrated in FIG. 2 and in intersecting planes when the flipper 22 is in the blocking orientation illustrated in FIG. 4. The rear arm 42 of the flipper 22 and the body 28 of the hook 20 (between the end 24 and the bump 30) are in the same plane when the flipper 22 is in the enabling orientation illustrated in FIG. 2 and in intersecting planes when the flipper 22 is in the blocking orientation illustrated in FIG. 4.

As best seen in FIG. 4, the flipper 22 is cammed in the direction of arrow 66 into the blocking orientation by the slot 14 of the forward or leading article 12' passing over the bump 30. The raised rear end of the flipper rear arm 42 then blocks all but the lead article 12' from being removed until the lead article 12' has passed beyond the bump 30. As best seen in FIG. 2, once the lead article 12' is past the bump 30 and on the hook free end 26, the lead article 12' cams the flipper 22 in the direction of arrow 68 into the enabling orientation, thereby allowing the next article 12 to be moved along the hook body 28 and onto the rear arm 42 of flipper 22.

While it is preferred that the flipper 22 actually be forcibly cammed into the enabling orientation by the passage of an article over the hook free end 26, in the absence of such forcible camming the relatively weak force of gravity is typically sufficient to cause the pivotable flipper to assume the enabling orientation as well (albeit with less certainty as the debris, sticky material and the like typically found in a store may impair the easy pivotability of flipper 22 and fix the flipper 22 in the blocking orientation against the relatively weak force of gravity).

While the dimensions of the peg hook 20 will vary with the intended applications thereof, typically in one preferred embodiment it is made of about 0.175 inch wire (optionally coated with plastic) formed in a "U" configuration with the legs, spaced apart about 0.925 inch. The central portion of the base of the "U" is preferably flattened to enable pivotal movement of the flipper 22 on the lateral portions of the base while preventing it from twisting completely thereabout. The longitudinal (i.e., horizontal) extension of the body 28 is about 4–10 inches. The bump 30 extends longitudinally about 0.5 inch to either side of the apex, and the height of the bump is about 0.277 inch. The hook free end 26 extends forwardly about 0.75 inch from the body 28. While the configuration and dimensions of the flipper 22 will vary with those of the peg hook 20, the front arm 40 of the flipper 22 is preferably about 1 inch by 0.5 inch by 0.175 inch (excluding rib 46), and the rear arm 42 is about 1 inch by 0.9 inch by 0.3 inch. The peg hook 20 and flipper 22 are conveniently separately injection molded (and, more particularly, insertion injection molded).

Because the peg hook assembly of the present invention enables only one article at a time to be removed therefrom, it slows down the removal from a peg hook of any sizable plurality of articles to the point where detection or apprehension of the thief becomes more likely.

While the assembly of the present invention has been described in the terms of a peg hook which is mounted in a substantially horizontal plane (with a vertically extending bump) for use with an article having a defined horizontally-extending slot, alternatively the peg hook may be mounted in a substantially vertical plane (with a horizontally extending bump) for use with an article having a defined vertically-extending slot. In other words, the assembly could be rotated 90° clockwise or counterclockwise for use with an article having a vertical slot rather than a horizontal slot. However, as the force of gravity is not available to bias the flipper to the enabling orientation in this embodiment, it may be necessary to deploy a spring or like biasing means to this end.

To summarize, the present invention provides a pilfer-resistant peg hook assembly which enables the removal of only one article at a time therefrom while at the same time enabling a rapid and easy removal of the forward or leading article by a simple, substantially horizontal motion. The assembly is easy and convenient for the prospective purchaser to use, and does not require the use of extraneous articles such as coins or keys. The assembly is simple and economical to manufacture, maintain and use.

Now that the preferred embodiments of the present invention have been shown and described in detail,various modifications and improvements thereon will become readily apparent to those skilled in the art. Accordingly, the spirit and scope of the present invention is to be construed broadly and limited only by the appended claims, and not the foregoing specification.

I claim:

1. A pilfer-resistant peg hook assembly for supporting a plurality of articles incorporating defined slots and enabling only one article at a time to be removed, comprising:

(A) a peg hook having a pair of opposed ends and a body connecting the same, one of said hook ends being configured and dimensioned to maintain said hook body in a first plane when mounted on an appropriate surface and the other of said hook ends being a free end, said hook body being configured and dimensioned to be received in the slots of the articles and defining a transversely extending bump adjacent to but spaced from said free end; and (B) a flipper pivotably secured to said hook adjacent said free end and being movable between an enabling orientation enabling at least partial passage of a lead article along said hook body and onto said flipper as the lead article moves towards said free end, and a blocking orientation precluding passage of a second article onto said flipper as the fist article moves towards said free end, said flipper normally remaining in said enabling orientation under the influence of gravity and being cammed into said blocking orientation by said first article passing over said bump.

2. The peg hook assembly of claim 1 wherein said flipper defines a generally planar front end and a generally planar rear end, said front and rear ends being disposed at an obtuse angle.

3. The peg hook assembly of claim 2 wherein said front and rear ends of said flipper define an obtuse angle of 140°–160°.

4. The peg hook assembly of claim 2 wherein said free end of said hook and said front end of said flipper are in the same plane when said flipper is in said enabling orientation and in intersecting planes when said flipper is in said blocking orientation.

5. The peg hook assembly of claim 4 wherein said rear end of said flipper and said body of said hook between said one end and said bump are in the same plane when said flipper is in said enabling orientation and in intersecting planes when said flipper is in said blocking orientation.

6. The peg hook assembly of claim 2 wherein said rear end of said flipper and said body of said hook between said one end and said bump are in the same plane when said flipper is in said enabling orientation and in intersecting planes when said flipper is in said blocking orientation.

7. The peg hook assembly of claim 1 wherein said flipper is cammed into said enabling orientation by an article passing over said free end.

8. The peg hook assembly of claim 1 wherein said flipper front end is pivotally secured to said free end and said flipper rear end extends generally towards said one end.

9. The peg hook assembly of claim 1 wherein said first plane is substantially horizontal and said bump extends vertically.

10. The peg hook assembly of claim 1 wherein said bump extends upwardly from said hook body.

11. A pilfer-resistant peg hook assembly for supporting a plurality of articles incorporating defined slots and enabling only one article at a time to be removed therefrom, comprising:

(A) a generally horizontal peg hook having a pair of opposed ends and a body connecting the same, one of said hook ends being configured and dimensioned to maintain said body substantially horizontal when mounted on an appropriate surface and the other of said hook ends being a free end, said hook body being configured and dimensioned to be received in the slots of the articles and defining a vertically extending bump adjacent to but spaced apart from said free end; and (B) a flipper pivotably secured adjacent said free end and extending partially towards said one end, said flipper defining a generally planar front end and a generally planar rear end, said front and rear ends being disposed at an obtuse angle of 140°–160°, said flipper being movable between a first enabling orientation enabling at least partial passage of an article along said hook body and onto said flipper as the article moves towards said free end, and a blocking orientation precluding passage of a second article onto said flipper as the first article moves towards said free end, said flipper normally remaining in said enabling orientation under the influence of gravity and being cammed into said blocking orientation by the first article passing over said bump and being cammed into said enabling orientation by said first article passing over said free end, said flipper front end being pivotably secured to said free end and said flipper rear end extending generally towards said one end;

said free end of said hook and said front end of said flipper being in the same plane when said flipper is in said enabling orientation and in intersecting planes when said flipper is in said blocking orientation, and said rear end of said flipper and said body of said hook between said one end and said bump being in the same plane when said flipper is in said enabling orientation and in intersecting planes when said flipper is in said blocking orientation.

* * * * *